US006341988B1

(12) United States Patent
Zhu et al.

(10) Patent No.: US 6,341,988 B1
(45) Date of Patent: Jan. 29, 2002

(54) STRADDLE HIGH DENSITY ELECTRICAL CONNECTOR

(75) Inventors: ZiQiang Zhu; Guohua Zhang; Lunsong Hu, all of Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/516,339

(22) Filed: Mar. 1, 2000

(30) Foreign Application Priority Data

Feb. 2, 2000 (TW) ..... 89201914 U

(51) Int. Cl.[7] ..... H01R 24/00
(52) U.S. Cl. ..... 439/630; 439/79
(58) Field of Search ..... 439/79, 80, 62, 439/570, 630, 637

(56) References Cited

U.S. PATENT DOCUMENTS 3,413,594 A * 11/1968 Fernald et al.
4,572,604 A * 2/1986 Ammon et al.
4,734,042 A * 3/1988 Martens et al. ..... 439/62
5,893,764 A * 4/1999 Long ..... 439/79
5,971,775 A * 10/1999 Tor et al. ..... 439/79

* cited by examiner

*Primary Examiner*—Khiem Nguyen
(74) *Attorney, Agent, or Firm*—Wei Te Chung

(57) ABSTRACT

A straddle high density electrical connector of the present invention comprises an insulative housing forming a projecting portion, a shield covering the projecting portion of the insulative housing, a pair of hooks, a plurality of terminals receiving in the insulative housing, and a pair of rivets for fastening the insulative housing, the shield and the hooks together. The insulative housing further comprises a pair of clamps positioned adjacent both ends thereof and extending rearwardly for clipping a printed circuit board therebetween. Each hook is positioned adjacent the corresponding clamp and has a pair of legs extending rearwardly from the housing, each leg has a tip at a free end thereof for inserting into a corresponding through hole defined in the printed circuit board which the electrical connector is mounted onto. In addition, each clamp comprises an upper receiving surface for engaging with the upper surface of the printed circuit board and a lower receiving surface for engaging with the lower surface of the printed circuit board, a triangular-shaped rib being formed on the lower receiving surface. Each tip of each hook projects beyond the corresponding upper receiving surface or lower receiving surface of a corresponding clamp, respectively.

7 Claims, 5 Drawing Sheets

STRADDLE HIGH DENSITY ELECTRICAL CONNECTOR

BACKGROUND OF THE INVENTION

The present invention relates to an electrical connector, and particularly to a straddle high density electrical connector which can be stably and accurately fixed onto a printed circuit board.

U.S. Pat. Nos. 5,603,639 and 5,893,764 disclose two different designs of electrical connectors which can be placed onto a printed circuit board with high precision. The U.S. Pat. No. 5,603,639 discloses an electrical connector which includes a connector body. A clamp piece receiving section is formed on each end of the connector body for engaging with a printed circuit board. However, special tools are required to properly position this electrical connector on the printed circuit board. The U.S. Pat. No. 5,603,639 was also designed to solve the location problem. The electrical connector of the U.S. Pat. No. 5,603,639 includes an elongated housing with a U-shaped mounting clip, and the U-shaped mounting clip further comprises a pair of legs joined by a bight portion. The legs are juxtaposed against two surfaces of a printed circuit board for connection to appropriate mounting pads. The electrical connector is adapted for straddle mounting to the printed circuit board at an edge thereof. However, the connection of the electrical connector and the printed circuit board before soldering only relies on the clamping of the legs to the pads. Such connection is not secure. If an outside force exceeding the clamping force is exerted against the connector, the connector can be moved from its desired position relative to the printed circuit board. Hence, an improved electrical connector is required to overcome the disadvantages of the prior art.

BRIEF SUMMARY OF THE INVENTION

A first object of the present invention is to provide an electrical connector which can be stably mounted to a printed circuit board;

A second object of the present invention is to provide an electrical connector which facilitates assembly to a printed circuit board.

Accordingly, a straddle high density electrical connector of the present invention comprises an insulative housing forming a projecting portion, a shield covering the projecting portion of the insulative housing, a pair of hooks, a plurality of terminals receiving in the insulative housing, and a pair of rivets for fastening the insulative housing, the shield and the hooks together. The insulative housing further comprises a pair of clamps positioned adjacent both ends thereof and extending rearwardly for clipping a printed circuit board therebetween. Each hook is positioned adjacent the corresponding clamp and has a pair of legs extending rearwardly from the housing, each leg has a tip at a free end thereof for inserting into a corresponding through hole defined in the printed circuit board which the electrical connector is mounted onto. In addition, each clamp comprises an upper receiving surface for engaging with the upper surface of the printed circuit board and a lower receiving surface for engaging with the lower surface of the printed circuit board, a triangular-shaped rib being formed on the lower receiving surface. Each tip of each hook projects beyond the corresponding upper receiving surface or lower receiving surface of a corresponding clamp, respectively.

Other objects, advantages and novel features of the invention will become more apparent from the following detailed description of the present embodiment when taken in conjunction with the accompanying drawings.

DETAILED DESCRIPTION OF THE INVENTION

Figure 1:
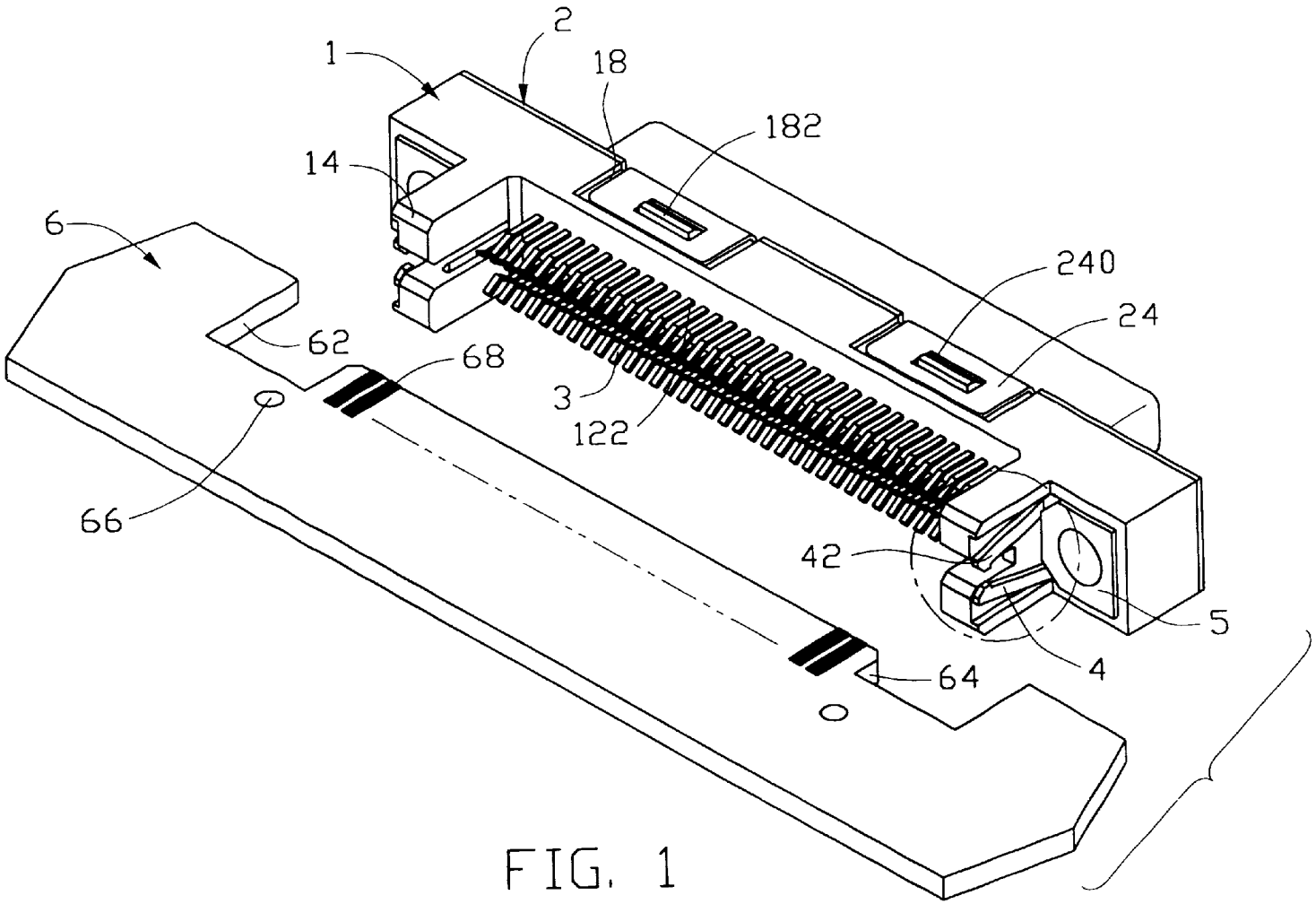
FIG. 1 is a perspective view of an electrical connector in accordance with the present invention and a printed circuit board for connection with the electrical connector.
Figure 2:
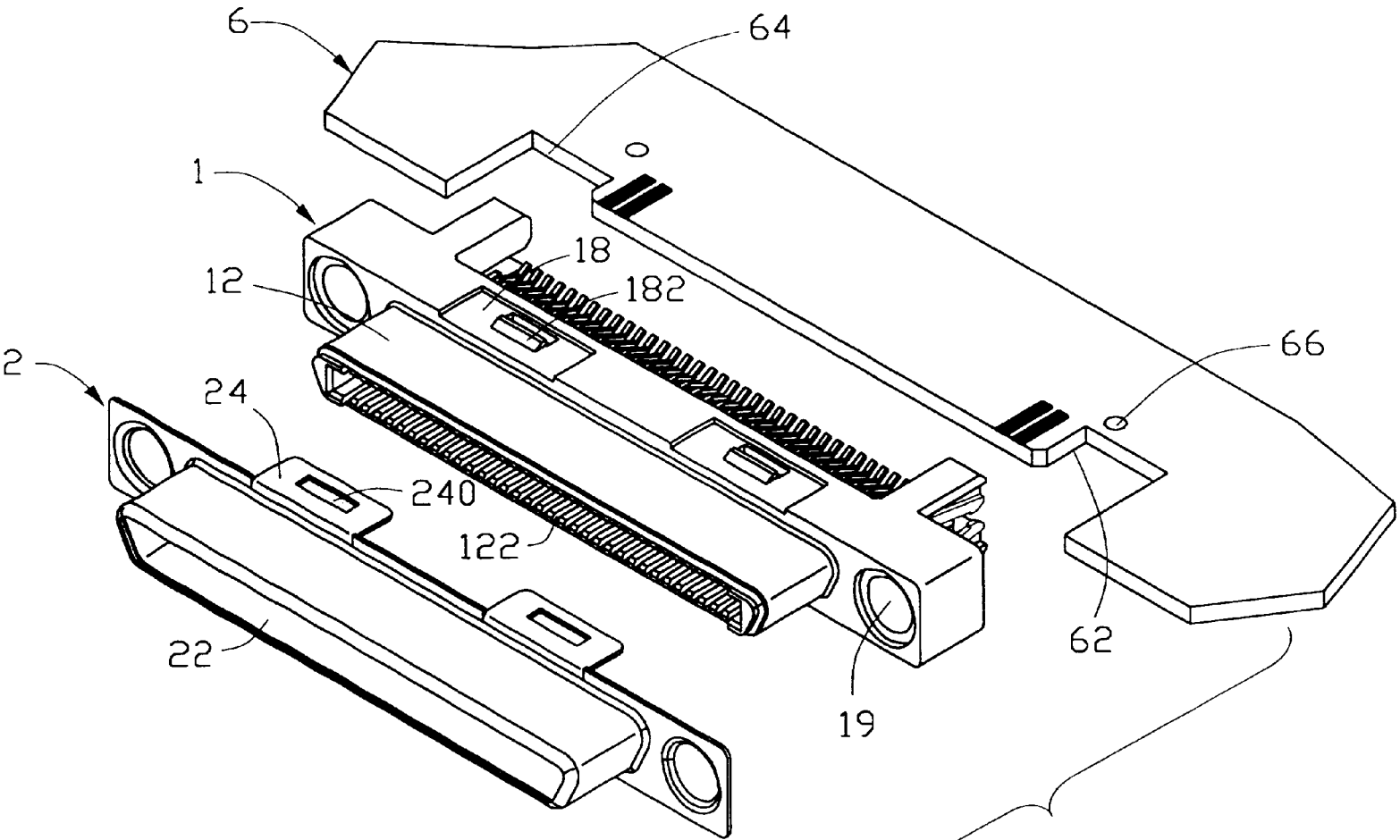
FIG. 2 is a view similar to FIG. 1 but from an opposite aspect, and a shield of the connector being separate from the connector.
Figure 3:
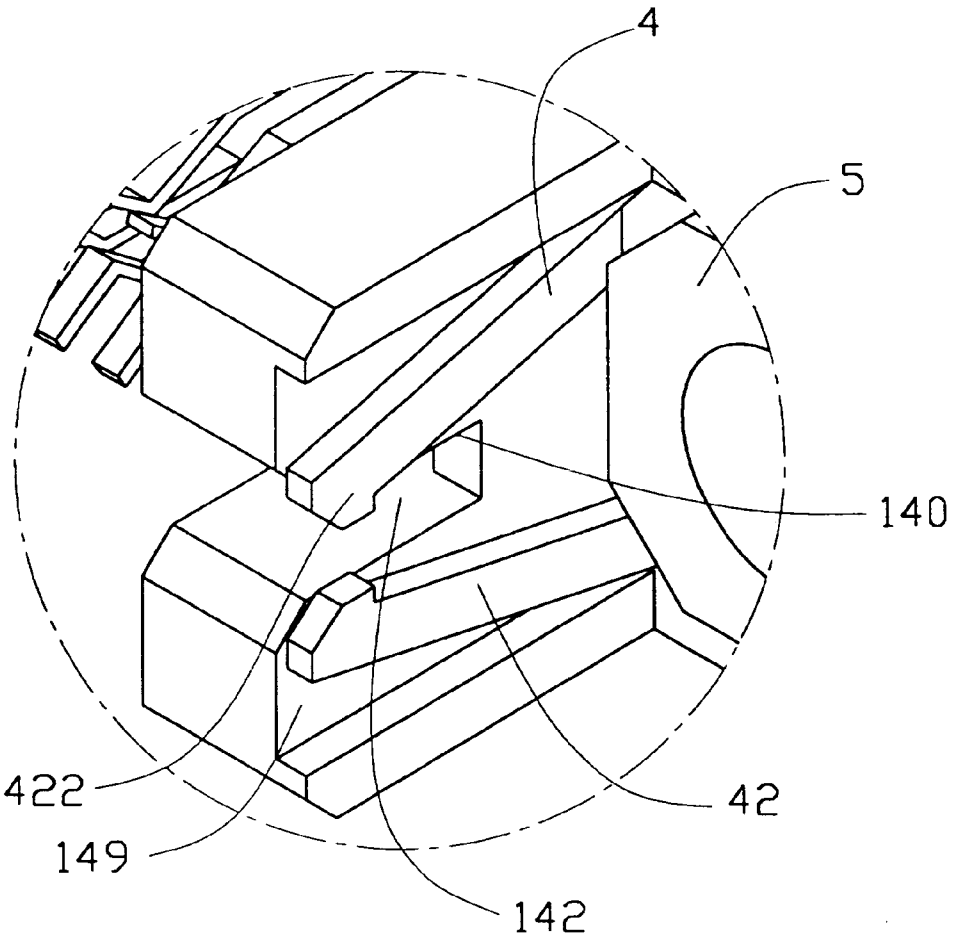
FIG. 3 is a partially enlarged view of FIG. 1.

Referring to FIGS. 1–3, an electrical connector in accordance with the present invention to be fixed onto a printed circuit board 6, comprises an insulative housing 1 having a forward projecting portion 12 for mating with a complementary connector (not shown), a conductive shield 2 covering the projecting portion 12, a plurality of terminals 3 received in the insulative housing 1, a pair of hooks 4 and a pair of rivets 5. The shield 2 comprises an opening 22 for receiving the projecting portion 12 and a plurality of retaining plates 24 extending rearwardly from upper and lower sides of the opening 22. Each retaining plate 24 defines an aperture 240 therein.

The insulative housing 1 further has a plurality of recesses 18 positioned on upper and lower sides thereof and to a rear side of the projection 12. The projecting portion 12 further defines a plurality of passageways 122 for receiving the terminals 3 to transfer signals therethrough. Each recess 18 defines a clipping block 182 to engage with the aperture 240 of the shield 2. A pair of holes 19 is positioned on lateral ends of the insulative housing 1 to receive a pair of rivets 5 (see FIG.1) therein for fastening the shield 2, the insulative housing 1 and a pair of hooks 4 together. A pair of clamps 14 is positioned near and between the two rivets 5, each extending rearwardly opposite to the projecting portion 12. A pair of metallic hooks 4, is each fixed in a recess l49 of the housing 1 positioned between a corresponding clamp 14 and rivet 5, is to retain the electrical connector on the printed circuit board 6.

Figure 4:
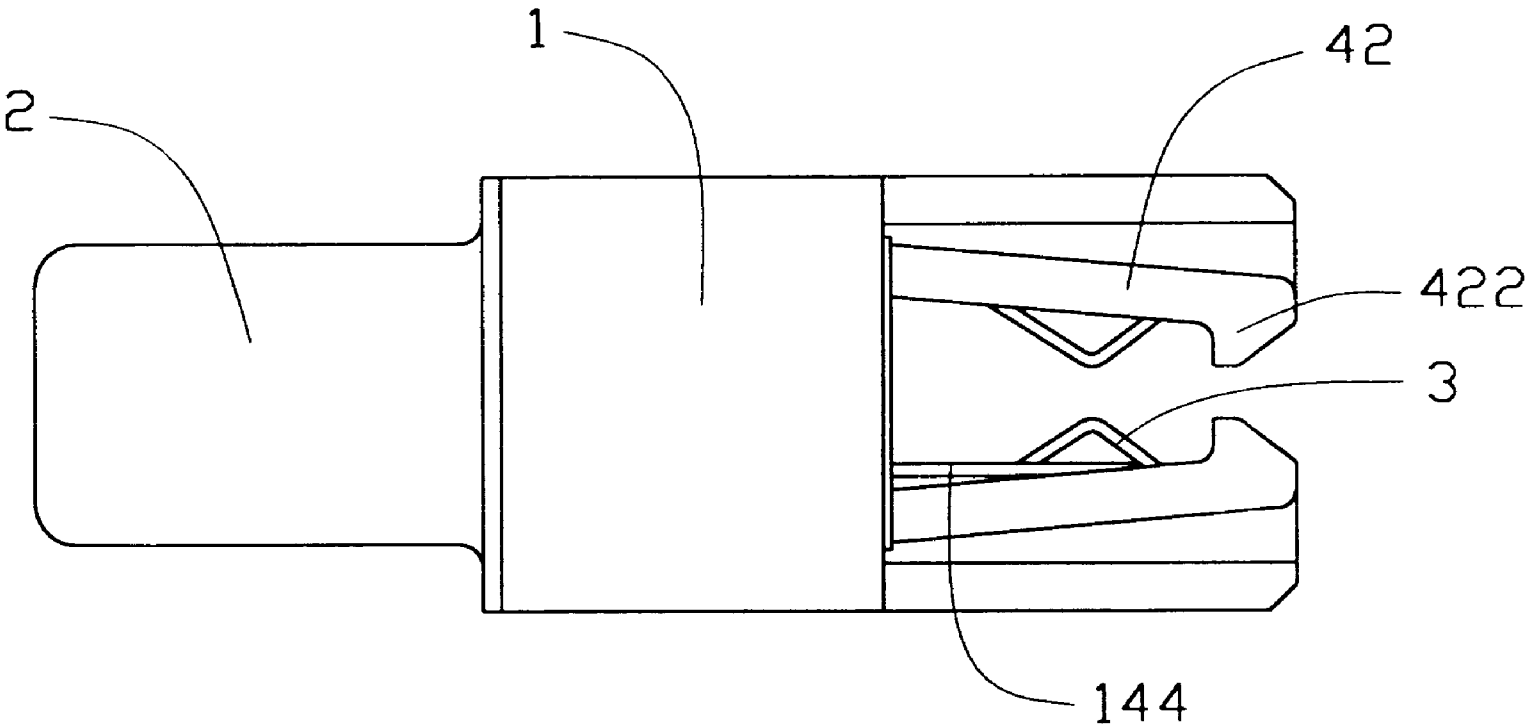
FIG. 4 is a side view of the electrical connector in accordance with the present invention.

Referring to FIGS. 1, 3 and 4, each clamp 14 comprises an upper receiving surface 140 and a lower receiving surface 142 for engaging upper and lower surfaces (not labelled) of the printed circuit board 6 when the connector and the printed circuit board 6 are assembled together. A triangular-shaped rib 144 is formed on each lower receiving surface 142 to ensure that the printed circuit board 6 can be firmly clamped by the clamps 14 when the connector is mounted to the printed circuit board 6. Each hook 4 consists of a pair of legs 42 projecting rearwardly from the housing 1 and toward each other at free ends thereof. The free ends each forms a tip 422 pointing toward each other. One tip 422 is positioned adjacent the upper receiving surface 140, while the other tip 422 is positioned adjacent the lower receiving surface 142, and the two tips 422 project beyond said upper and lower receiving surfaces 140, 142. In addition, each clamp 14 defines a recess 149 for receiving a corresponding hook 4.

Figure 5:
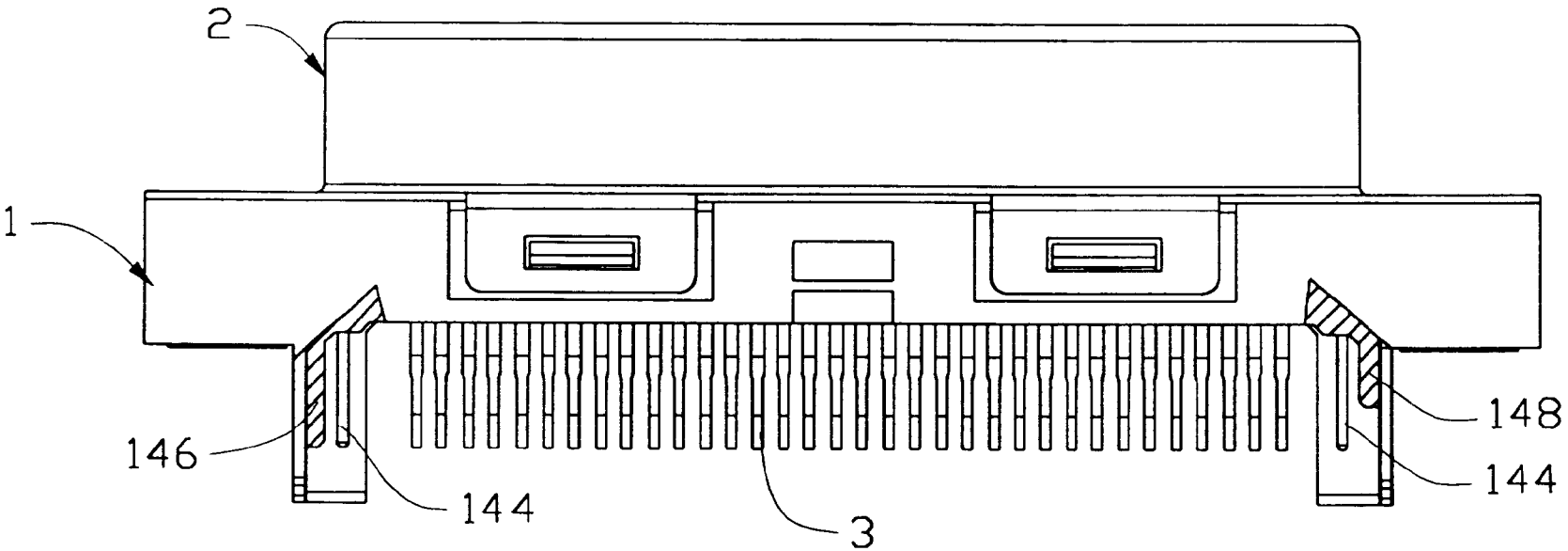
FIG. 5 is a top view, partly in cross section, of the electrical connector in accordance with the present invention.

Referring to FIG. 5, a first baffle 146 and a second baffle 148 are respectively formed on the clamps 14. The two baffles 146, 148 have different lengths, the first baffle 146 being longer than the second baffle 148. Referring to FIGS. 1–2, the printed circuit board 6 comprises a plurality of golden finger 68 on the upper and lower surfaces (only the upper surface show) thereof, a pair of through holes 66, a first notch 62 and a second notch 64. The two notches 62, 64 have different depths to cooperate with the two baffles 146, 148 of the clamps 14 respectively, and the through holes 66 are sized to receive the tips 422 of the hooks 4 to retain the electrical connector on the printed circuit board 6.

In assembling, the connector is straddle mounted to an edge of the printed circuit board 6 by fitting the clamp 14 with the shorter baffle 148 into the second notch 64 and the clamp l4 with the longer baffle 146 into the first notch 62 until a position is reached wherein the tips 422 of the hooks 4 fit within the corresponding through holes 66. At this position, the upper receiving surfaces 140 of the clamps 14 and the lower receiving surface 142 of the clamps 14 with the ribs 144 clamp the printed circuit board therebetween, the rearward edges of the ribs 144 abutting a forward edge of the printed circuit board, and tail portions of the terminals 3 engage with the golden fingers 68 to transfer signals/power.

During assembly, the different depth of the notches 62, 64 perform a polarizing function together with the baffles 146, 148 to prevent incorrect assembly of the connector with the printed circuit board 6; the clamps 14 further perform a guidance function to guide the connector to a secure mounting with the printed circuit board 6; and the tips 422 of the hooks 4 which fit into the through holes 66 of the printed circuit board 6 provide a retaining function to secure the connector to the printed circuit board 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A straddle high density electrical connector for being mounted on a printed circuit board having a plurality of golden fingers on upper and lower surfaces thereof and defining a pair of through holes therethrough, comprising:

an insulative housing having an extending projecting portion for mating with a complementary connector, and a pair of rearwardly extending clamps positioned adjacent both ends of the housing for clipping to an edge of the printed circuit board;

a pair of hooks positioned respectively adjacent the clamps, each consisting of a pair of legs extending rearwardly from the housing, each leg having a tip at a free end thereof for inserting into a corresponding through hole of the printed circuit board;

a plurality of terminals received in the insulative housing for engaging with the golden fingers of the printed circuit board for transferring signals;

wherein each clamp comprises an upper receiving surface for engaging with the upper surface of the printed circuit board and a lower receiving surface for engaging with the lower surface of the printed circuit board, a rib being formed on the lower receiving surface;

wherein the rib has a triangular-shaped configuration;

wherein the clamps further comprise first and second baffles having dissimilar lengths, and the printed circuit board defines a first notch and a second notch, each having a depth from a forward edge of the printed circuit board which corresponding to the lengths of the first baffle and the second baffle, respectively, the baffles being for engaging an edge of the printed circuit board when the connector is assembled thereto;

wherein the hooks are located near the clamps, respectively, and the tips project beyond the corresponding upper receiving surface and lower receiving surface of a corresponding clamp, respectively.

2. The electrical connector as claimed in claim 1, wherein the hooks each is received in a corresponding recess of each corresponding clamp.

3. The electrical connector as claimed in claim 1, wherein a conductive shield covers the projecting portion of the insulative housing to protect the terminals from electromagnetism interference.

4. The electrical connector as claimed in claim 3, wherein a pair of rivets is assembled in the housing near each clamp, for securing the insulative housing, the shield and the hooks, together.

5. A combination of an electrical connector and a printed circuit board, comprising:

a printed circuit board having upper and lower surfaces, an edge between the upper and lower surfaces and forming first and second notches with different depths, and a plurality of golden fingers on at least one of the upper and lower surfaces and near the edge; and an electrical connector comprising:

an insulative housing;

a number of terminals received in the housing for electrically engaging with the golden fingers;

a pair of clamps extending from the housing for being inserted into the notches of the printed circuit board to clamp the printed circuit board, the clamps forming two baffles with different lengths, respectively, wherein the clamp with the longer baffle extends into the deeper notch and the clamp with the shorter baffle extends into the other notch, and wherein the baffles engage with the edge of the printed circuit board.

6. The combination as claimed in claim 5, wherein a dimension of the edge of the printed circuit board between the first notch and the second notch is equal to a distance between the longer baffle and the shorter baffle.

7. A straddle type connector for use with a printed circuit board, comprising:

an insulative housing defining a mating portion, and a pair of clamps rearwardly extending adjacent two opposite ends thereof, each of said clamps defining an upper receiving surface and a lower receiving surface for respectively engaging upper and lower surfaces of the printed circuit board;

a shield positioned on the housing and enclosing the mating portion;

a pair of hooks closely positioned by two sides of the corresponding clamps, respectively; and a pair of rivets positioned at said two opposite ends of the housing and extending through the corresponding hooks, the housing and the shield for fastening the hooks, the housing and the shield together; wherein each of said hooks includes a pair of rearward legs with tips respectively extending beyond the corresponding upper receiving surface and lower receiving surface of the clamp aside.

* * * * *